United States Patent [19]

Sohoel

[11] Patent Number: 4,761,146

[45] Date of Patent: Aug. 2, 1988

[54] COAXIAL CABLE CONNECTOR ASSEMBLY AND METHOD FOR MAKING

[75] Inventor: Eivind O. Sohoel, East Hampton, Conn.

[73] Assignee: SPM Instrument Inc., Marlborough, Conn.

[21] Appl. No.: 41,152

[22] Filed: Apr. 22, 1987

[51] Int. Cl.[4] ..... H01R 17/18

[52] U.S. Cl. ..... 439/584; 439/275

[58] Field of Search ..... 29/861, 748, 754, 828, 29/854, 857, 862, 882, 867; 439/322, 578, 579, 580, 581, 582, 583, 584, 585, 610, 393, 394

[56] References Cited

U.S. PATENT DOCUMENTS

| | | | |
|---|---|---|---|
| 3,103,548 | 9/1963 | Concelman | 439/585 |
| 3,170,748 | 2/1965 | Van Horssen | 439/584 |
| 3,448,430 | 6/1969 | Kelly | 439/610 |
| 3,781,762 | 12/1973 | Quackenbush | 439/585 |
| 3,907,399 | 9/1975 | Spinner | 439/583 |
| 4,339,166 | 7/1982 | Dayton | 439/393 |
| 4,613,199 | 9/1986 | McGeary | 439/585 |

*Primary Examiner*—David Pirlot

*Attorney, Agent, or Firm*—McCormick, Paulding and Huber

[57] ABSTRACT

A connector assembly for terminating a shielded coaxial cable includes a female connector element having a bore containing an electrical contact and a male connector assembly including a plurality of individual connecting members carried by an end portion of the cable and received within the bore. The connecting members include a radially expandable shield connector affixed to the end of the cable, an annular thrust washer received on the cable for expanding the shield connector, an elastomeric O-ring seal received on the cable adjacent the thrust washer, a cylindrical plunger slidably received on the cable for engaging the O-ring seal and a cap nut threadably engaged with the female connector for urging the plunger in an axial direction and toward the O-ring seal whereby to urge the central conductor within the cable into electrical contacting engagement with the electrical contact, radially expand the shield connector within the bore and radially expand the O-ring into sealing engagement with the wall of the bore and the outer jacket of the cable in response to force applied to the O-ring seal by the plunger when the cap nut is rotated in a tightening direction relative to the female connector. A method for making the connector assembly is also disclosed.

16 Claims, 2 Drawing Sheets

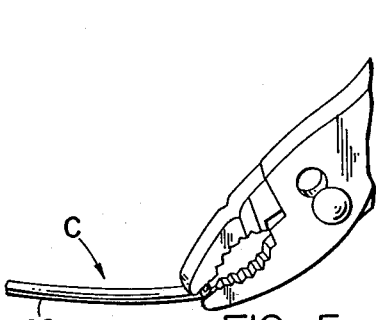
FIG. 5
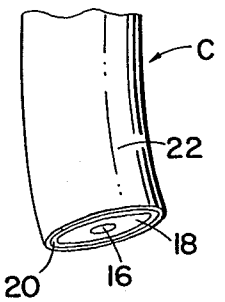
FIG. 4
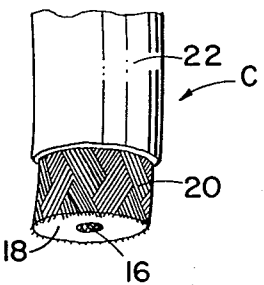
FIG. 6
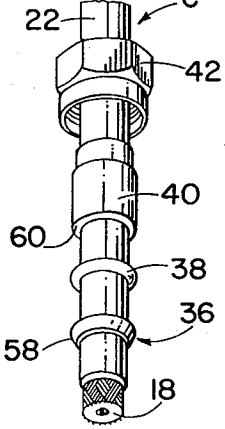
FIG. 7
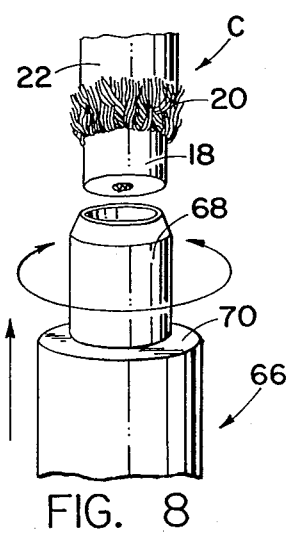
FIG. 9
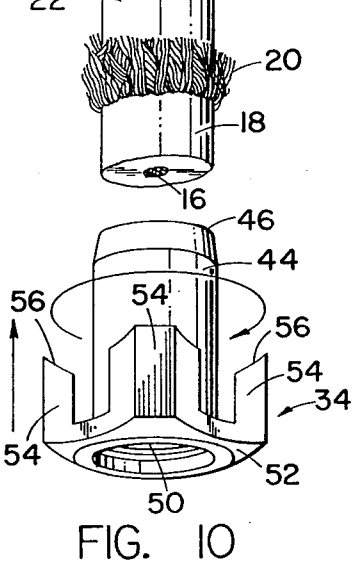
FIG. 10
FIG. 8
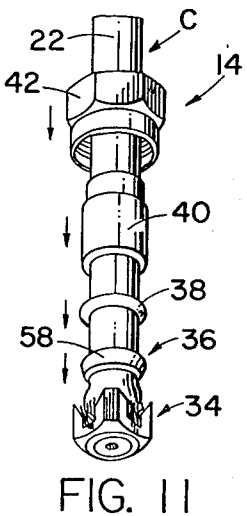
FIG. 11

COAXIAL CABLE CONNECTOR ASSEMBLY AND METHOD FOR MAKING

BACKGROUND OF THE INVENTION

This invention relates in general to electrical connector assemblies and deals more particularly with an improved sealed connector assembly for terminating a coaxial cable.

The connector assembly of the present invention is particularly adapated for use in hostile environments where it may be exposed to water, oil, moisture, dust, or other contaminants which adversely affect the integrity of cable termination. The present connector assembly is particularly suitable for use with a piezo-electric transducer which comprises part of a shock pulse measuring instrument system for bearing condition monitoring in an industrial plant environment. In such a system the transducer may be and often is connected directly to the housing of a bearing or to a machine to be monitored and sends signals through an associated coaxial cable to remote instrumentation. The efficient functioning of such a system is often dependent upon the integrity of the coaxial cable termination at the transducer which may be exposed to extremely harsh environmental conditions in the immediate vicinity of a bearing or machine being monitored.

Accordingly, it is the general aim of the present invention to provide an improved sealed electrical connector assembly for terminating a coaxial cable and which assembly is virtually impervious to dust, moisture, chemicals, and other contaminants likely to adversely affect cable termination.

SUMMARY OF THE INVENTION

In accordance with the present invention an improved connector assembly is provided for terminating a coaxial cable having a central conductor, an annular inner insulation layer in coaxial surrounding engagement with the conductor, an annular conducting shield in coaxial surrounding engagement with the inner insulation layer, and an outer insulation jacket in coaxial surrounding engagement with the conducting shield. The connector assembly generally comprises a female connector having an outwardly open cylindrical connector bore for receiving an end portion of the coaxial cable and an electrical contact disposed within and centrally of the connector bore for engaging the central conductor. The connector assembly further includes a male connector assembly having a radially expandable shield connector, means for attaching the shield connector to the end portion of the coaxial cable in electrical conducting engagement with the conducting shield, and thrust means for radially expanding the shield connector within the connector bore in response to force applied in an axial direction to the thrust means to establish electrical continuity between the conducting shield and the female connector. The male connector assembly further includes resilient deformable annular sealing means for positioning in coaxial surrounding engagement with the cable end portion within the connector bore. The sealing means is radially expandable into sealing engagement with the cable and the connector bore in response to force applied in an axial direction to the sealing means. A means is provided for applying force in the axial direction to the sealing means and the thrust means and urging the central conductor into engagement with the electrical contact.

BRIEF DESCRIPTION OF THE DRAWINGS

FIGS. 4–11 illustrate successive steps in making the connector assembly shown in FIGS. 1–3.

DETAILED DESCRIPTION OF PREFERRED EMBODIMENT

Figure 1:
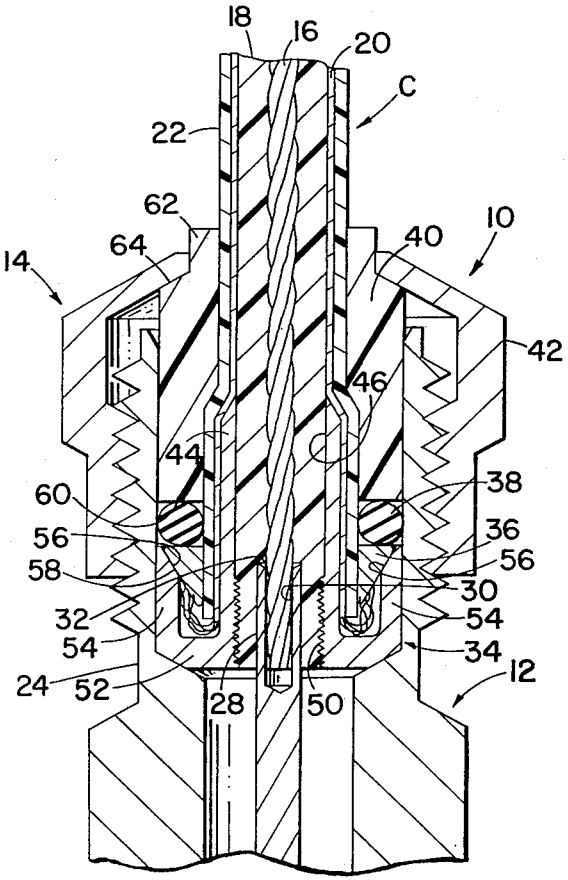
FIG. 1 is a fragmentary axial sectional view through a sealed electrical connector assembly embodying the present invention and shown in general terminating relation to an associated coaxial cable.

Referring now to the drawings, an illustrated connector assembly embodying the present invention and indicated generally by the numeral 10 is illustrated in FIG. 1 in terminating relation with an end portion of an associated coaxial cable designated by the letter C. The connector assembly 10 essentially comprises a female connector, indicated generally by the numeral 12 and best shown in FIG. 2, and a male connector assembly, designated generally by the numeral 14 in FIG. 3 and including a plurality of individual connector elements mounted on the end portion of the cable C for cooperating with the female connector 12, as will be hereinafter more fully discussed.

Before further considering the connector assembly 10, the cable C will be more fully described. Referring particularly to FIG. 1 the illustrated coaxial cable C, which is of indeterminent length, essentially comprises a stranded wire central conductor indicated by the numeral 16. An inner insulation jacket 18, formed from suitable resilient electrical insulating material, is disposed in coaxial surrounding engagement with the central conductor 16. An annular electrical conducting shield 20 is arranged in coaxial surrounding engagement with the inner insulation jacket 18. The construction of the conducting shield 20 may vary. However, the illustrated shield 20 comprises a braided wire shield of a type well known in the art. An outer insulation jacket 22 formed from suitable resilient electrical insulating material is disposed in coaxial surrounding engagement with the conducting shield 20.

Figure 2:
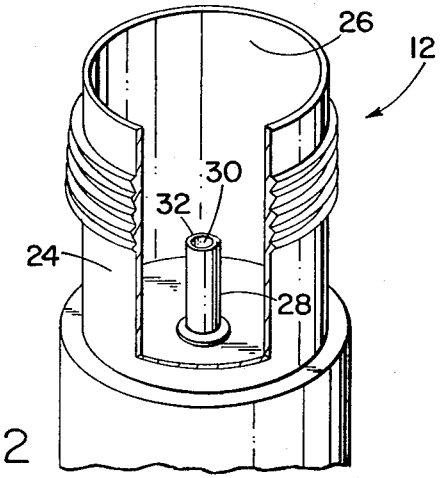
FIG. 2 is a somewhat reduced fragmentary perspective view of the female connector of FIG. 1.

Considering now the connector assembly 10 in further detail, the illustrated female connector 12, best shown in FIG. 2, comprises a part of a piezo-electric transducer of the type used in a shock pulse measuring instrument system for monitoring bearing condition. The transducer may be adapted for direct connection to a bearing housing or the like. However, a disclosure of the transducer is not essential to the understanding of the present invention, therefor, details of the transducer are not shown.

The illustrated female connector has an externally threaded generally cylindrical body portion 24 and an outwardly open generally cylindrical blind connector bore 26. A hollow contact 28 disposed within and centrally of the connector bore, substantially as shown, comprises a generally cylindrical contact pin which projects coaxially outward from the inner end wall of the bore 26. The contact pin 28 has a central bore 30 and a sharpened edge 32 at the outer end of the bore 30.

Figure 3:
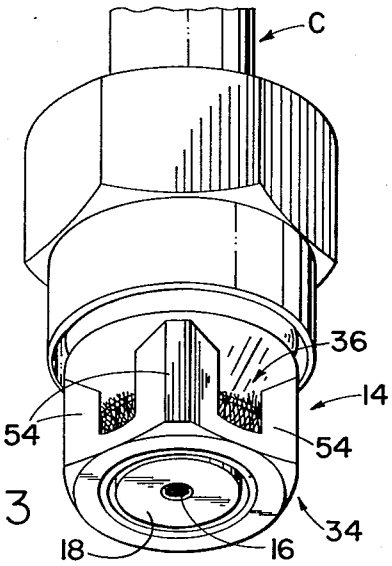
FIG. 3 is a somewhat reduced perspective view of the male connector assembly of FIG. 1.

As previously noted, the male connector assembly, indicated generally at 14 in FIG. 3, is formed by a plurality of individual connecting members assembled on an end portion of the conductor C. Specifically, the illustrated assembly 14 includes a radially expandable shield connector, indicated generally at 34, for attachment to the end portion of the coaxial cable C in electrical conducting engagement with the conducting shield 20, an annular thrust member 36 positioned on the cable C for radially expanding the shield connector, and a radially deformable annular sealing member or O-ring 38 for positioning on the coaxial cable C in surrounding engagement with the cable within the bore 26. The illustrated assembly 14 further includes a cylindrical plunger 40 and a cap nut 42, respectively received on the coaxial cable C and which will be hereinafter more fully described.

The shield connector 34 is preferably made from a corrosion resitive electrically conductive material such as brass and has a cylindrical sleeve portion 44 which includes a sleeve bore 46 having an inside diameter substantially equal to the outside diameter of the inner insulation layer 18. The upper end of the sleeve portion, as it appears oriented in the drawings, is upwardly and inwardly conically tapered and terminates at a relatively sharp upper edge which defines the upper end of the sleeve bore. The sleeve bore 46 is internally threaded at its lower end as indicated at 50 in FIG. 1. The shield connector further includes a diametrically enlarged head portion 52 integrally connected to the lower end of the sleeve portion 44 and a plurality of integral equiangularly spaced and radially outwardly expandable resilient fingers 54,54 which project upward from the head portion 52 in radially spaced relation to the sleeve portion 44. The upper ends of the fingers 54,54 have downwardly and inwardly inclined cam surfaces 56,56 thereon, which preferably lie within a conical surface of revolution having its central axis conincident with the axis of the sleeve 44 portion and its apex located some distance below the head portion 52.

The shield conductor 34 is adapted to be positioned on the lower end portion of the coaxial conductor C with the sleeve portion 44 in coaxial surrounding engagement with the inner insulation layer 18 and disposed between the inner insulation layer 18 and the the braided shield 20, substantially as shown in FIG. 1. The threaded portion of the sleeve bore, indicated at 50, is adapted to form a thread on the inner insulation layer 18 during assembly for attaching the shield connector 34 in fixed position on the lower end portion of the coaxial conductor C. It will be noted that portions of the braided shield 20 and the resilient outer insulation jacket 22 associated with the sleeve portion 44 are somewhat diametrically enlarged as a result of the sleeve portion being positioned between the inner insulation layer 18 and the shield 20.

The thrust member 36 essentially comprises a thrust washer having a generally cylindrical bore, the diameter of which is substantially equal to the enlarged diameter portion of the coaxial cable C in the region of the sleeve portion 44. The thrust washer 36 has a conical downward converging outer surface 58 which substantially complements the cam surfaces 56,56.

The O-ring 38 is preferably made from an elastomeric material and has an inside diameter sized to fit snugly over the diametrically enlarged portion of the outer insulation jacket 22 associated with the sleeve portion 44. The outside diameter of the undeformed O-ring is approximately equal to the inside diameter of the connector bore 26.

The cylindrical plunger 40 has a central bore sized to receive the coaxial cable C therethrough and to slide freely on the coaxial cable C. A generally radially disposed abutment surface 60 on the lower end of the plunger is adapted for engagement with the O-ring 38, substantially as shown in FIG. 1. The upper end portion of the plunger has a diametrically reduced cylindrical portion 62 received within a circular opening in the cap nut 42. An annular bearing surface 64 surrounds the diametrically reduced portion and is adapted for engagement with an associated complementary bearing surface on the cap nut. The latter nut is internally threaded for threadable engagement with the female connector 12.

FIGS. 4–10 illustrate a method for terminating a coaxial cable in accordance with the present invention. An end portion of a coaxial cable C is first cut normal to the cable axis, as shown in FIG. 4. The cut end of the cable may be brought back "into round" with a plier using light pressure as shown in FIG. 5. An end portion of the outer jacket 22 is stripped from the cable C to expose an end portion of the conducting shield 20, as it appears in FIG. 6. Thereafter, the cap nut 42 is slipped onto the cable followed by the pusher 40, the O-ring 38 and the thrust washer 36 (FIG. 7).

The exposed end portion of the braided conducting shield is now turned upwardly over the lower end of the outer jacket 22. The braided conducting shield 20 and the outer insulation jacket 22 are thereafter diametrically enlarged to provide a space between the inner insulation layer 18 and the conducting shield 20 for receiving the sleeve portion 44 therein. In accordance with the presently preferred method for practicing the invention, a rotary hand tool indicated generally at 66 and having an end portion 68 shaped like the sleeve portion 44 is provided for this purpose. The hand tool 66, shown in FIGS. 8 and 9, is forced over the exposed end portion of the inner insulation layer 18 while being simultaneously rotated and is forceably inserted between the inner insulation layer 18 and the braided conducting shield 20 which may shave some insulation from the outer surface of the insulation layer 18. An abutment surface 70 on the tool is provided for engaging the shield 20 when a space of proper depth has been formed between the conducting shield 20 and insulation jacket 22 to accomodate the sleeve portion 44. The tool 66 is then removed from the end portion of the coaxial cable C, as shown in FIG. 9, and any insulation material which has been removed by this expanding process is brushed away.

The shield connector 34 is now attached to the prepared end portion of the coaxial cable C by slipping the sleeve 44 over the exposed end portion of the inner insulation layer 18. The shield connector is now rotated and simultaneously pushed in an axial direction toward the coaxial cable to cause the threads 50 to cut into and form complimentary threads on the end portion of the inner insulation layer 18 whereby the shield connector 34 is attached in fixed position to the end portion of the coaxial cable C. Upon completion of this operation any part of the inner insulation jacket 18 or the conductor 16 which extends beyond the head portion 52 is trimed flush with the head portion of the shield connector. The completed male connector assembly is shown in FIG. 10.

When the cap nut 25 is threaded onto the female connector 12, the cap nut, acting through the plunger 40, applies force in an axial direction to the O-ring 38 which is trapped between the abutment surface 60 on the plunger and an associated abutment surface on the thrust washer 36. The initial axially directed force applied to the O-ring by the plunger is transferred from the O-ring to the thrust washer and to the shield connector 34 affixed to the lower end portion of the coaxial cable C. This initial force causes the sharp upper edges of the contact pin 28 to penetrate the inner insulation layer 18 surrounding the conductor 16 and engage the conductor which is received within the contact pin bore 30. The shield connector head portion 52 ultimately "bottoms out" on the inner end of the connector bore 26, substantially as shown in FIG. 1. Thereafter, further rotation of the cap nut 42 relative to the female connector 12 and in a tightening direction causes the coengaging cam surfaces 58 on the thrust washer and 56,56 on the shield connector to move relative to each other to radially expand the fingers 54,54 into griping engagement with the wall of the connector bore 26. The axially directed force applied by the cap nut 25 and the plunger also cause axial compression and radial expansion of the elastomeric O-ring 38 to effect sealing engagement of the O-ring with the insulation jacket 22 and the wall of the connector bore 26. The radially inwardly directed force exerted by the O-ring seal upon the enlarged portion of the insulation jacket 22 associated with the sleeve 44 also urges the conducting shield 20 into electrical contacting engagement with the sleeve portion 44 whereby effective electrical continuity between the shield connector 34 and the electrically conductive shield 20 is assured. Portions of the braided conducting shield may also be trapped between the cam surfaces 56,56 and 58 which further enhances electrical conductivity between the braided conducting shield and the shield conductor 34. Further, engagement of the fingers 54,54 with the female connector within the connector bore 26 assures electrical continuity between the conducting shield 20 and the female electrical connector 12. Thus, termination with a high degree of integrity is affected. Since, critical termination of the coaxial cable conductor 16 and the conducting shield 20 occur within the conductor bore 26 which is effectively sealed by the O-ring 38 environmental contaminants can not enter the conductor bore to adversely affect terminations.

In this specification the relative terms upper and lower have been used for convenience to describe the connector assembly as it appears in the drawings. However, it should be understood that the coaxial connector assembly of the present invention may be used in any orientation.

I claim:

1. A connector assembly for terminating a coaxial cable having a central conductor, an annular inner insulation layer in coaxial surrounding engagement with the central conductor, an annular conducting shield in coaxial surrounding engagement with the inner insulation layer, and an outer insulation jacket coaxially surrounding the conducting shield, said connector assembly comprising a female connector having an outwardly open cylindrical connector bore for receiving an end portion of the cable and electrical contact means disposed within and centrally of said connector bore for engagement with the central conductor, and a male connector assembly including a radially expandable shield connector having a cylindrical sleeve portion, means for attaching the shield connector in fixed position to the end portion of the coaxial cable with said sleeve portion in coaxial surrounding engagement with the inner insulation layer between the inner insulation layer and said conducting shield and in electrically conducting engagement with the conducting shield and including a thread on the interior of said sleeve portion for threadable engagement with the inner insulation layer, thrust means for radially expanding said shield connector within said connector bore in response to force applied in an axial direction to said thrust means to establish electrical continuity between said conducting shield and said female connector, resilient deformable annular sealing means for positioning in coaxial surrounding engagement with the cable within said connector bore, said sealing means being radially expandable into sealing engagement with the cable and said connector bore in response to force applied in an axial direction to said sealing means, and means for applying force in said axial direction to said sealing means and said thrust means and urging the central conductor into engagement with said contact means.

2. A connector assembly for terminating a coaxial cable as set forth in claim 1 wherein said thrust means comprises an annular member coaxially surrounding an associated portion of said cable and said shield connector and said annular member have coengageable cam surfaces thereon.

3. A connector assembly for terminating a coaxial cable as set forth in claim 1 wherein said contact comprises a hollow pin for penetrating said inner insulation layer and receiving an end portion of the central conductor therein in response to said force.

4. A connector assembly for terminating a coaxial cable as set forth in claim 1 wherein said shield connector includes an integral diametrically enlarged head portion and a plurality of equiangularly spaced radially expandable fingers projecting from said head portion in radially spaced relation to said sleeve portion.

5. A connector assembly for terminating a coaxial cable as set forth in claim 4 wherein said thrust means comprises an annular thrust washer coaxially surrounding an associated portion of said cable and said fingers and said thrust washer have coengageable cam surfaces thereon.

6. A connector assembly for terminating a coaxial cable as set forth in claim 1 wherein said force applying means comprises a nut received on said cable and threadably engaged with said female connector.

7. A connector assembly for terminating a coaxial cable as set forth in claim 6 wherein said force applying means further includes a plunger slidably received on said cable between said nut and said sealing means.

8. A connector assembly for terminating a coaxial cable as set forth in claim 7 wherein said sealing means comprises an elastomeric O-ring.

9. A connector assembly for terminating a coaxial cable having a central conductor, an annular inner insulation layer in coaxial surrounding engagement with the conductor, an annular conducting shield in coaxial surrounding engagement with the inner insulation layer, and an outer insulation jacket coaxially surrounding the conducting shield, said connector assembly comprising a female connector having an outwardly open cylindrical connector bore for receiving an end portion of the cable and having an electrical contact disposed within and centrally of said connector bore, and a male connector assembly including a radially expandable shield connector having a cylindrical sleeve portion including a sleeve bore extending coaxially therethrough for receiving an associated end portion of the inner insulation layer therein, said sleeve portion coaxially surrounding the inner insulation layer and being disposed between the inner insulation layer and said cunducting shield, said shield connector having a diametrically enlarged head portion integrally connected to an associated end of said sleeve portion and a plurality of equiangularly spaced fingers projecting from said head portion in radially outwardly spaced relation to said sleeve portion, means for attaching the shield connector in fixed position to the end portion of the coaxial cable in electrically conducting engagement with the conducting shield and including an internal thread formed on said shield connector within said sleeve bore for engaging an end portion of said coaxial cable, thrust means including a thrust washer coaxially surrounding an associated portion of the coaxial cable for radially expanding said shield connector within said connector bore in response to force applied in an axial direction to said thrust means to establish electrical continuity between said conducting shield and said female connector, said fingers and said thrust washer having coengageable cam surfaces thereon, resilient deformable annular sealing means for positioning in coaxial surrounding engagement with the coaxial cable within said connector bore, said sealing means being radially expandable into sealing engagement with the coaxial cable and said connector bore in response to force applied in an axial direction to said sealing means, and means for applying force in said axial direction to said sealing means and said thrust means and urging the conductor into engagement with said electrical contact.

10. A connector assembly for terminating a coaxial cable as set forth in claim 9 wherein said force applying means comprises a nut threadably engaged with said female connector.

11. A connector assembly for terminating a coaxial cable as set forth in claim 10 wherein said force applying means includes a generally cylindrical plunger slidably received on the coaxial cable between said nut and said sealing means.

12. A connector assembly for terminating a coaxial cable as set forth in claim 11 wherein said sealing means comprises an elastomeric O-ring.

13. A method for terminating a coaxial cable having a central conductor, an annular inner insulation layer in coaxial surrounding engagement with the central conductor, an annular conducting shield in coaxial surrounding engagement with the inner insulation layer, and an outer insulation jacket coaxially surrounding the conducting shield, said method comprising the steps of providing a female connector having an outwardly open cylindrical connector bore for receiving an end portion of the cable and electrical contact means disposed within and centrally of said connector bore, providing a rotary hand tool having a cylindrical end portion, coaxially rotating the tool relative to the end portion of the cable while simultaneously applying force to the tool in an axial direction and toward the cable to radially expand an end portion of said conducting shield and said outer insulation jacket to form a coaxial annular space between said conducting shield and said inner insulation layer, providing a radially expandable shield connector having a cylindrical sleeve portion generally corresponding to the cylindrical end portion of said rotary hand tool and means for expanding said shield connector within said connector bore in response to force applied in an axial direction to said expanding means, forcibly inserting said cylindrical sleeve portion into said annular space, attaching said shield connector in fixed position to the end portion of said coaxial cable, positioning an annular elastomeric sealing member in coaxial surrounding relation to the expanded end portion of said outer insulation jacket associated with said sleeve portion and generally adjacent said expanding means, positioning within said connector bore the end portion of said coaxial cable with said shield connector, said expanding means and said sealing member thereon, and applying force in an axial direction and toward said coaxial cable to said sealing member to urge said central conductor into engagement with said electrical contact means, expand said shield connector into engagement with the wall of said connector bore and radially expand said elastomeric sealing member into sealing engagement with said coaxial cable and the wall of said connector bore.

14. A method for terminating a coaxial cable as set forth in claim 13 wherein the step of applying force is further characterized as threading a nut onto said female connector.

15. A method for terminating a coaxial cable as set forth in claim 13 including the additional step of stripping an end portion of the outer insulation jacket from the coaxial cable to expose an end portion of the conducting shield and turning the exposed end portion of the conducting shield back on the cable to coaxially surround the end portion of the outer insulation jacket, the latter steps to be performed before the step of attaching said shield connector.

16. A method for terminating a coaxial cable having a central conductor, an annular inner insulation layer in coaxial surrounding engagement with the central conductor, an annular conducting shield in coaxial surrounding engagement with the inner insulation layer, and an outer insulation jacket coaxially surrounding the conducting shield, said method comprising the steps of stripping an end portion of the outer insulation jacket from the coaxial cable to expose an end portion of the conducting shield, turning the exposed end portion of the conducting shield back on the cable to coaxially surround the end portion of the outer insulation jacket, providing a female connector having an outwardly open cylindrical connector bore for receiving an end portion of the cable and electrical contact means disposed within and centrally of said connector bore, radially expanding an end portion of said conducting shield and said outer insulation jacket to form a coaxial annular space between said conducting shield and said inner insulation layer, providing a radially expandable shield connector having a cylindrical sleeve portion and means for expanding said shield connector within said connector bore in response to force applied in a axial direction to said expanding means, forcibly inserting said cylindrical sleeve portion into said annular space, attaching said shield connector in fixed position to the end portion of said coaxial cable, positioning an annular elastomeric sealing member in coaxial surrounding relation to the expanded end portion of said outer insulation jacket associated with said sleeve portion and generally adjacent said expanding means, positioning within said connector bore the end portion of said coaxial cable with said shield connector, said expanding means and said sealing member thereon, and applying force in an axial direction and toward said coaxial cable to said sealing member to urge said central conductor into engagement with said electrical contact means, expand said shield connector into engagement with the wall of said connector bore and radially expand said elastomeric sealing member into sealing engagement with said coaxial cable and the wall of said connector bore.

* * * * *